US007868907B2

(12) United States Patent
Akamine et al.

(10) Patent No.: US 7,868,907 B2
(45) Date of Patent: Jan. 11, 2011

(54) THERMAL HEAD DRIVING IC AND METHOD OF CONTROLLING THE SAME

(75) Inventors: Tadao Akamine, Chiba (JP); Toshihiko Omi, Chiba (JP)

(73) Assignee: Seiko Instruments Inc. (JP)

( * ) Notice: Subject to any disclaimer, the term of this patent is extended or adjusted under 35 U.S.C. 154(b) by 391 days.

(21) Appl. No.: 12/011,383

(22) Filed: Jan. 24, 2008

(65) Prior Publication Data

US 2008/0180512 A1 Jul. 31, 2008

(30) Foreign Application Priority Data

Jan. 29, 2007 (JP) ..... 2007-017603

(51) Int. Cl.
*B41J 2/32* (2006.01)

(52) U.S. Cl. ..... 347/211

(58) Field of Classification Search ..... 347/211
See application file for complete search history.

(56) References Cited

U.S. PATENT DOCUMENTS 4,132,865 A * 1/1979 Szechenyi ..... 379/32.01
6,771,109 B2 8/2004 Nakase ..... 327/333

FOREIGN PATENT DOCUMENTS

JP 2004015402 1/2004

* cited by examiner

*Primary Examiner*—Huan H Tran
(74) *Attorney, Agent, or Firm*—Adams & Wilks

(57) ABSTRACT

A thermal head driving IC for supplying voltage to a plurality of heating resistors each controlled by a driving MOS transistor includes a switch for making and breaking electrically between a substrate and a source of the plurality of driving MOS transistors. In a case where the plurality of heating resistors are activated, the plurality of driving MOS transistors are turned on and the switch is turned off, whereby the substrate potential is floated. As a result, the substrate potential is forward-biased against the source by a substrate current generated in a high-electric-field depletion region near the drain, and a parasitic bipolar transistor turns on, whereby both the plurality of driving MOS transistors and the parasitic bipolar transistor turn on. In a case where the plurality of heating resistors are not activated, a signal for turning off the plurality of driving NMOS transistors is given, and the switch is turned on.

2 Claims, 2 Drawing Sheets

THERMAL HEAD DRIVING IC AND METHOD OF CONTROLLING THE SAME

BACKGROUND OF THE INVENTION

1. Field of the Invention

The present invention relates to a thermal head driving integrated circuit (IC) for controlling activation of a plurality of heating resistors.

2. Description of the Related Art

FIG. 2 is a circuit diagram showing an example of a conventional thermal head driving IC.

In the thermal head driving IC, a heating resistor 2 is connected to a heating resistor power supply 1, and the heating resistor 2 is connected to an output terminal 3 for the thermal head driving IC. The driving NMOS transistor 5 is disposed between the output terminal 3 and a ground 4. When a gate terminal 6 of the driving NMOS transistor 5 is set high, the driving NMOS transistor 5 is turned on and current flows through the heating resistor 2 to generate heat. Also, when the gate terminal 6 of the driving NMOS transistor 5 is set low, the driving NMOS transistor 5 is turned off and no current flows through the heating resistor 2 to generate no heat.

If the on-resistance of the driving NMOS transistor 5 is high when the driving NMOS transistor 5 is turned on and a current flows through the heating resistor 2 to generate a heat, voltage drop occurs in the driving NMOS transistor 5 causing decrease in voltage to the heating resistor 2 and eventually insufficient heating. An increase in a channel width of the driving NMOS transistor 5 reduces the on-resistance of the driving NMOS transistor 5, however, such results in a chip size of the thermal head driving IC becoming larger, leading to a problem of increase in cost.

In order to increase a driving-capability of a MOS transistor without increasing the channel width thereof, in the conventional art, for example, there is disclosed a method of applying a voltage such that a substrate potential of the MOS transistor is biased against the source in a forward direction of a PN diode, thereby turning on a parasitic bipolar transistor (for example, see JP 2004-15402 A).

However, in the method of biasing the substrate potential of the MOS transistor in a forward direction against the source, it is inevitable to supply the base current for the parasitic bipolar transistor in order to bias the substrate. Consequently, a new problem arises in that a current consumption of the IC increases. The parasitic bipolar transistor has a large base width, and the $h_{FE}$ thereof becomes considerably larger compared to a standard bipolar transistor, and thus an increase in the current consumption becomes a major problem.

SUMMARY OF THE INVENTION

In order to solve the above-mentioned problems, the following means is adopted in a thermal head driving IC according to the present invention.

The thermal head driving IC for controlling activity of a plurality of heating resistors by a plurality of driving MOS transistors corresponding to each of heating resistors, including a switch for making and breaking electrically between a substrate and a source of each of the plurality of driving NMOS transistors, in which: in a case where the voltage is supplied to the selected heating resistors, a signal for turning on the selected driving MOS transistors is given, and the corresponding switches are turned off; and in a case where the plurality of heating resistors are not selected, a signal for turning off the plurality of driving MOS transistors is given, and the switches are turned on.

By means of the present invention, the substrate potential is forward-biased against the source by substrate current generated in the high electric field of depletion region near the drain when heating resistors are activated, since the driving MOS transistors are turned on and the corresponding switches for making and breaking between the substrate and the source of the plurality of MOS transistors are turned off to make the substrate potential float, causing a parasitic bipolar transistor to turn on. As a result, the plurality of driving MOS transistors and the parasitic bipolar transistor both turn on, permitting increase in driving capability without increasing the chip size. Further, different from a case of the prior art, in which current is supplied within the IC so as to bias the substrate in a forward direction, the current consumption of the IC does not increase.

DETAILED DESCRIPTION OF THE PREFERRED EMBODIMENT

Figure 1:
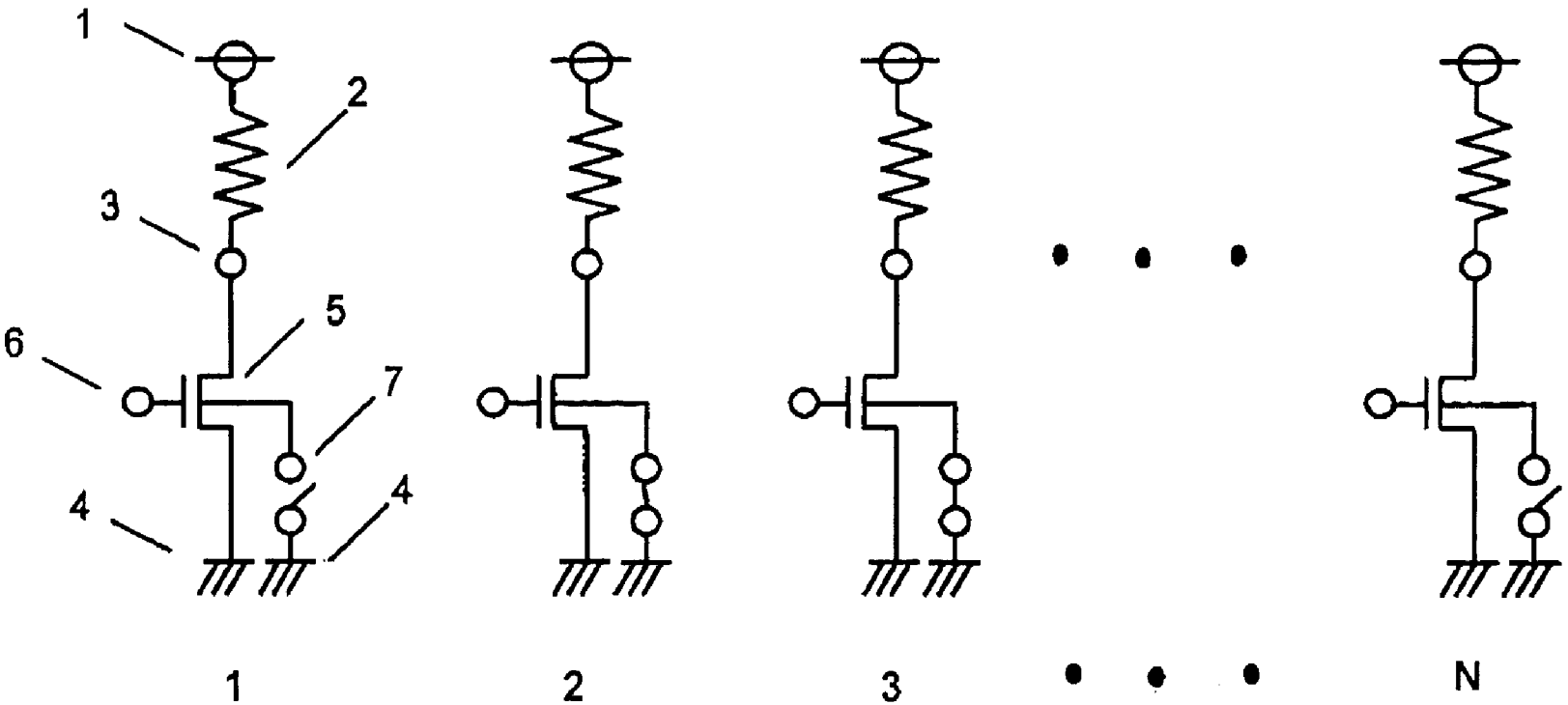
FIG. 1 is a circuit diagram showing an example of a thermal head driving IC according to the present invention.
Figure 2:
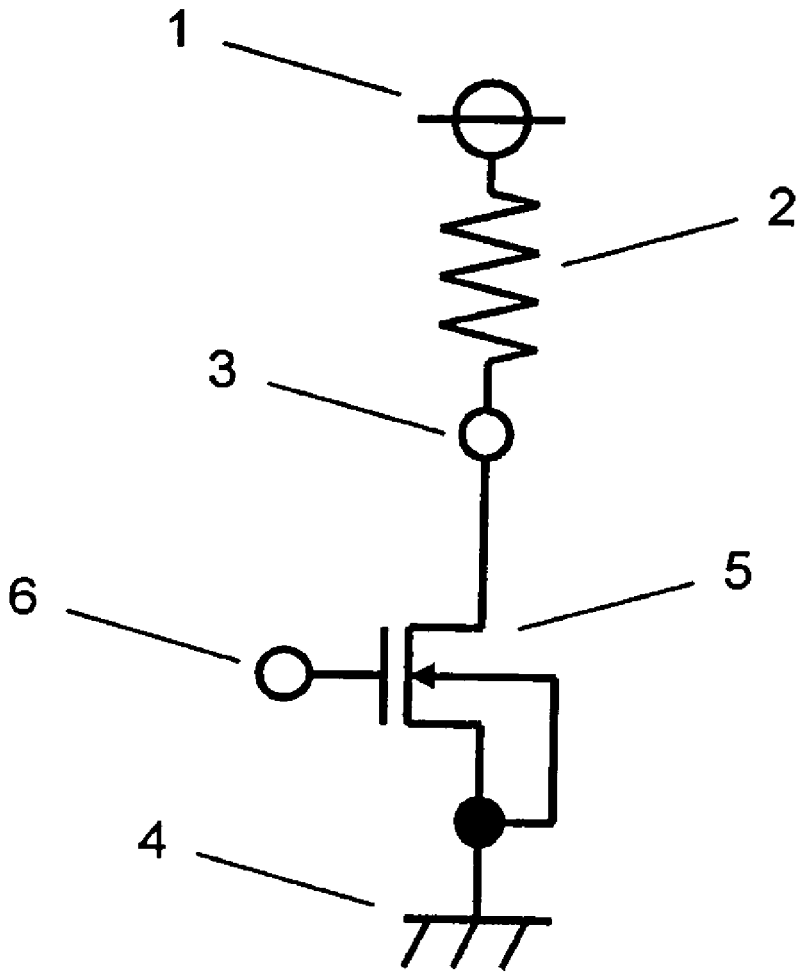
FIG. 2 PRIOR ART
FIG. 2 is a circuit diagram showing an example of a conventional thermal head driving IC.

FIG. 1 is a circuit diagram showing a thermal head driving IC according to a first embodiment of the present invention.

An actual thermal head driving IC includes a plurality of heating resistors 2 and a plurality of driving MOS transistors 5 corresponding to the plurality of heating resistors 2. Here, some of the heating resistors 2 and some of the MOS transistors are described with reference to the drawing, but other heating resistors 2 and other driving MOS transistors 5 have the same structure as that described below.

A heating resistor power supply 1 existing outside the IC and the heating resistor 2 connected thereto are, through a driving NMOS transistor output terminal 3 disposed on the surface of the IC, connected to a drain of a driving NMOS transistor 5 within the IC. A source of the driving NMOS transistor 5 is connected to a ground 4. A signal input to the gate terminal 6 controls on and off of the driving NMOS transistor 5, whereby controlling the current flowing through the heating resistor 2. Further, there is disposed a switch 7, which makes and breaks the substrate and the source of the driving NMOS transistor 5.

In a case where the voltage is applied to the heating resistor 2, the gate terminal 6 is set high to turn on the driving NMOS transistor 5, and the switch 7 disposed between the substrate of the driving NMOS transistor 5 and the ground 4 is turned off. Electrons flow through the channel of the driving NMOS transistor 5 and a part of the electrons accelerated by the drain electric field excite electrons in the valence band, thus generating holes which flow into the substrate. Since the switch 7 is turned off, an electric potential of the substrate becomes higher than that of the source to easily turn on the parasitic bipolar transistor of NPN type. When the parasitic bipolar transistor of NPN type turns on, the on-resistance becomes extremely lower compared to the case where only the driving NMOS transistor turns on, thereby supplying sufficient current to the heating resistor 2.

In a case where the heating resistor 2 is not activated, the gate terminal 6 is set low to turn off the driving NMOS transistor 5, and the switch 7 disposed between the substrate of the driving NMOS transistor and the ground is turned on. The electric potential of the substrate is close to the electric potential of the source, and thus the parasitic bipolar transistor of NPN type easily turns off.

In this embodiment, the maximum value of the current is limited by the heating resistor, even in a case where the parasitic bipolar transistor turns on and the on-resistance becomes extremely low, because the current is supplied to the heating resistor 2. Accordingly, in the present invention, when the resistance of the heating resistor 2 and the voltage of the heating resistor power supply 1 are appropriately set, break down of the driving NMOS transistor 5 due to an extremely large amount of current can be avoided.

What is claimed is:

1. A thermal head driving IC for supplying voltage to a plurality of heating resistors, comprising:

a plurality of driving MOS transistors each connected to one of the heating resistors; and a plurality of switches connected to respective ones of the driving MOS transistors for making and breaking electrically between a substrate and a source of the respective driving MOS transistors, wherein in a case where selected heating resistors are activated, a signal to the corresponding driving MOS transistors is given to turn them on, and the switch connected to each of the turned-on driving MOS transistors is turned off, and wherein in a case where selected heating resistors are not activated, a signal to the corresponding driving MOS transistors is given to turn them off, and the switch connected to each of the turned-off driving MOS transistors is turned on.

2. A method of controlling a thermal head driving IC for supplying voltage to a plurality of heating resistors, comprising:

providing a plurality of driving MOS transistors connected to respective ones of the heating resistors;

providing a plurality of switches connected to respective ones of the driving MOS transistors for making and breaking electrically between a substrate and a source of the respective driving MOS transistors;

giving a first signal to selected driving MOS transistors to turn on the selected driving MOS transistors;

turning off the switch connected to each of the selected driving MOS transistors;

giving a second signal to non-selected driving MOS transistors to turn off the non-selected driving MOS transistors; and turning on the switch connected to each of the non-selected driving MOS transistors.

* * * * *